US005562031A

United States Patent [19]

Garner et al.

[11] Patent Number: 5,562,031

[45] Date of Patent: Oct. 8, 1996

[54] METHOD AND APPARATUS FOR DRIVING A BRIDGE ROLLER ON A PRINTING PRESS

[75] Inventors: Steve M. Garner, Arlington; Max W. Hess, N. Richland Hills, both of Tex.

[73] Assignee: Sun Graphic Technologies, Inc., Ft. Worth, Tex.

[21] Appl. No.: 228,757

[22] Filed: Apr. 18, 1994

Related U.S. Application Data

[63] Continuation-in-part of Ser. No. 17,769, Feb. 16, 1993, abandoned.

[51] Int. Cl.[6] ..... B41F 7/26; B41F 7/36; B41F 31/10

[52] U.S. Cl. ..... 101/148; 101/450.1

[58] Field of Search ..... 101/148, 147, 101/350, 363, 364, 349, 450.1

[56] References Cited

U.S. PATENT DOCUMENTS

| | | | |
|---|---|---|---|
| 3,467,008 | 9/1969 | Domotor | 101/142 |
| 3,986,452 | 8/1972 | Dahlgren | 101/148 |
| 4,686,901 | 8/1987 | Arndt et al. | 101/148 |
| 5,191,835 | 3/1993 | Blanchard | 101/148 |

*Primary Examiner*—J. Reed Fisher
*Attorney, Agent, or Firm*—Geoffrey A. Mantooth

[57] ABSTRACT

A printing press has a plate cylinder, an inking system and a dampening system. A bridge roller provides a path between the inking and dampening systems. The bridge roller is in contact with a dampening form roller, which in turn is in contact with the plate cylinder. The dampening form roller is driven by an arrangement that allows the dampening form roller to rotate at a differential speed with respect to the plate cylinder in order to clean hickies off of the plate cylinder. The speed of the bridge roller is controlled so as to provide a slip nip between the bridge roller and the dampening form roller and so as to control the ink-water balance, even when the dampening form roller is rotating at a differential speed.

12 Claims, 5 Drawing Sheets

METHOD AND APPARATUS FOR DRIVING A BRIDGE ROLLER ON A PRINTING PRESS

SPECIFICATION

This application is a continuation-in-part of application Ser. No. 08/017,769, filed Feb. 16, 1993, now abandoned.

FIELD OF THE INVENTION

The present invention relates to printing presses, and in particular, to those printing presses that utilize a bridge roller.

BACKGROUND OF THE INVENTION

In lithographic printing presses, ink and dampening fluid are applied to a lithographic printing plate. The printing plate is mounted onto a plate cylinder which rotates the printing plate past ink and dampening form rollers. The printing plate contains oleophilic and hydrophilic areas. The oleophilic areas are arranged according to the desired image which is to be printed onto media such as paper. The oleophilic areas attract the oil-based ink. Nonprint areas on the printing plate attract the water-based dampening fluid and repel the ink.

In order to achieve satisfactory printing, a proper balance must be achieved between the amount of dampening fluid applied to the printing plate versus the amount of ink that is applied. This is referred to as the ink-water balance. If too much dampening fluid is applied, then the print areas look faded, as the dampening fluid begins to be applied to the oleophilic areas. If too little dampening fluid is applied, then the ink appears in nonink areas.

The inking and dampening fluid are applied to the printing plate with ink and dampening fluid form rollers, respectively. The inking rollers apply ink from a reservoir onto the printing plate, by way of the ink form rollers. Likewise, the dampening form rollers apply dampening fluid from a pan to the printing plate.

The ink form rollers and the dampening form roller may be kept separate from each other. However, in many press configurations, the dampening form roller is bridged to one of the ink form rollers by way of a bridge roller. The bridge roller and the dampening form roller work together to stabilize and maintain the proper ink-water balance.

In one type of prior art dampening system, the bridge roller is rotated by friction by the adjacent dampening form roller and ink form roller. The dampening form roller is generally rotated at the same surface speed as the plate cylinder. However, occasionally, the dampening form roller is slowed down so as to clean hickies off of the plate cylinder. When the dampening form roller changes speed, the speed of the bridge roller also changes, thus affecting the ink-water balance. As the dampening form roller is slowed down, excessive emulsification of the ink and dampening fluid occurs. Excessive emulsification is undesirable, as it degrades print quality. It is therefore desirable to control this mixing by controlling the speed of the bridge roller.

SUMMARY OF THE INVENTION

It is the object of the present invention to provide a method and apparatus for driving a bridge roller in a controlled manner.

The method of the present invention is for operating a printing press which has a plate cylinder, a dampening form roller and a bridge roller. The dampening form roller is in contact with the plate on the plate cylinder and the bridge roller is in contact with the dampening form roller. The method rotates the plate cylinder at a first surface speed. The dampening form roller is rotated at a second surface speed, with the second surface speed being different from the first surface speed. While rotating the dampening form roller at the second surface speed, the bridge roller is rotated at a third surface speed, the third surface speed being different than the second surface speed, wherein a slip nip is created between the bridge roller and the dampening form roller.

In one aspect of the method of the present invention, the surface speed of the dampening form roller is changed from the second surface speed to the first surface speed and the bridge roller rotational speed is maintained at the third surface speed.

In still another aspect of the present invention, the third surface speed of the bridge roller is the same speed as the first surface speed of the plate cylinder.

In another aspect of the present invention, the dampening form roller is rotated by a plate cylinder drive by way of a phasing differential gear set, wherein the rotational speed of the dampening form roller can be changed.

The present invention also provides a dampening system for use on a printing press, which press has a plate cylinder and a means for rotating the plate cylinder at a first surface speed. The dampening system includes a dampening form roller, a bridge roller in contact with the dampening form roller, means for rotating the dampening form roller at adjustable surface speeds relative to a surface speed of the plate cylinder and means for rotating the bridge roller at the same surface speed of the plate cylinder.

In one aspect of the dampening system, the means for rotating the bridge roller at the same surface speed as the plate cylinder includes a gear train that is structured and arranged to rotatably couple to the means for rotating the plate cylinder.

In still another aspect of the present invention, the means for rotating the dampening form roller at adjustable surface speeds relative to the plate cylinder surface speed includes a phasing differential gear set and a trim motor. The phasing differential gear set has a first input and an output. The first input is structured and arranged to couple to the means for rotating the plate cylinder. The output is rotatably coupled to the dampening form roller. The phasing differential gear set has a second input for trimming the rotational speed of the output relative to the first input. The trim motor is coupled to the second input.

BRIEF DESCRIPTION OF THE DRAWINGS

FIG. 5*a* shows an inner portion (relative to the press frame) of the drive arrangement, while FIG. 5*b* shows an outer portion of the drive arrangement.

DESCRIPTION OF THE PREFERRED EMBODIMENTS

Figure 1:
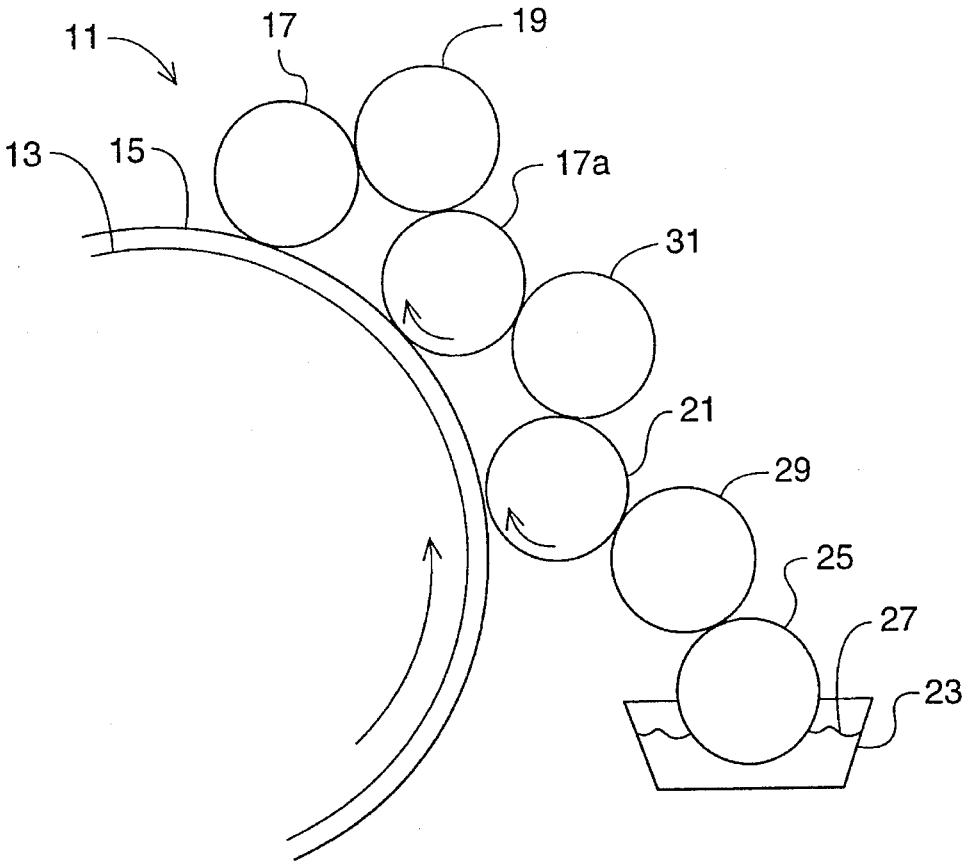
FIG. 1 is a schematic end view of various rollers in a printing press, including a plate cylinder and form rollers.

In FIG. 1, there is shown a schematic diagram of a printing press 11. The press 11 has a plate cylinder 13, with a lithographic printing plate 15 mounted around the outside diameter of the plate cylinder 13. There are also ink form rollers 17 that are in contact with the printing plate 15. The plate cylinder 13 may have two or four ink form rollers 17. One of the ink form rollers 17*a* is located in an upstream position (with reference to the direction of rotation of the plate cylinder) from the other ink form rollers. This ink form roller is typically referred to as the first ink form roller 17*a*. Each pair of ink form rollers has an ink vibrator roller 19 in contact therewith. In addition to these rollers, the inking system has other rollers (not shown) that bring ink from an ink reservoir to the ink vibrator roller.

The press 11 has a dampening form roller 21 that is in contact with the printing plate 15. A dampening fluid pan 23 is provided. A metering roller 25 is located in the pan, such that a portion of the metering roller is submerged in dampening fluid 27. A transfer roller 29 is in contact with the dampening form roller and the metering roller.

The printing plate 15 on the plate cylinder has ink receptive areas (the print areas) and nonink areas (the nonprint areas). The ink receptive areas receive ink from the form rollers, while the nonink areas receive dampening fluid from the form rollers.

A bridge roller 31 is provided in contact with the first ink form roller 17*a* and with the dampening form roller 21. The bridge roller 31 provides a path between the dampening system and the inking system, thereby allowing some mixing to occur between the ink and dampening fluid before being applied to the printing plate. The bridge roller 31 can have a variety of surfaces and durometers. For example, the bridge roller can be ink receptive, wherein it has a covering of rubber or some other elastomeric composition, hard plastic, nylon, copper plating, etc. Alternatively, the bridge roller covering could be receptive to dampening fluid. Such a bridge roller covering would be of polished chrome.

The printing press may be either of the sheet fed or web type. The press may have plural towers, with each tower having a plate cylinder and associated inking and dampening form rollers. Each tower is used to print a single color in multicolored printing operations. Each tower may be equipped with a bridge roller and with the bridge roller drive arrangement discussed hereinafter.

The rollers and cylinders are rotatably mounted to a press frame. The press frame includes a vertical side wall 33 located at each end of the rollers and cylinders (see FIG. 2). A motor 35 is rotatably coupled to the plate cylinder 13 by way of gears 37, 39, 41. Thus, the press motor 35 drives the plate cylinder 13. The ink vibrator roller 19 is rotatably coupled to the plate cylinder 31 by gears 43, 45. The ink form rollers 17 are friction driven by the ink vibrator roller 19 and by the plate cylinder 13. The plate cylinder has a gap in a portion of its outside diameter. As this gap rotates past the ink form rollers, the ink vibrator roller rotates the ink form rollers.

The transfer and metering rollers 29, 25 are typically rotated by a separate motor. The motor may be rotatably coupled to the transfer and metering rollers either by way of gears or by a drive belt. The dampening form roller 21 is rotated by its own motor. This motor is separate from the press motor 35 and also from the motor driving the metering and transfer rollers. This allows the dampening form roller to be rotated independently of the speed of the plate cylinder. The motor may be coupled to the dampening form roller by either gears or a belt. MacConnell, et al., U.S. Pat. No. 5,158,017 discloses the drive mechanisms for the rollers and other aspects of a printing press in more detail. The disclosure, including the specifications and drawings, of MacConnell, et al. U.S. Pat. No. 5,158,017 is incorporated herein by reference.

The bridge roller 31 is rotated by its own drive arrangement. The bridge roller drive arrangement allows the bridge roller to be rotated at speeds that are independent of the first ink form roller 17*a* and the dampening form roller 21. In one embodiment (see FIG. 2), the bridge roller is driven by a belt 47 directly from the ink vibrator roller 19. A first sheave 49 is coupled to the ink vibrator roller 19 and a second sheave 51 is coupled to the bridge roller 31. The belt 47 is looped around both sheaves. A spring loaded tension pulley 53 is provided to allow the bridge roller to actuate in and out of contact with the form rollers. Such actuation allows the form rollers to move off of the plate cylinder during cleaning operations. The diameters of the sheaves 49, 51 are such that the surface speed of the bridge roller 31 is the same as the surface speed of the plate cylinder 13.

Figure 2:
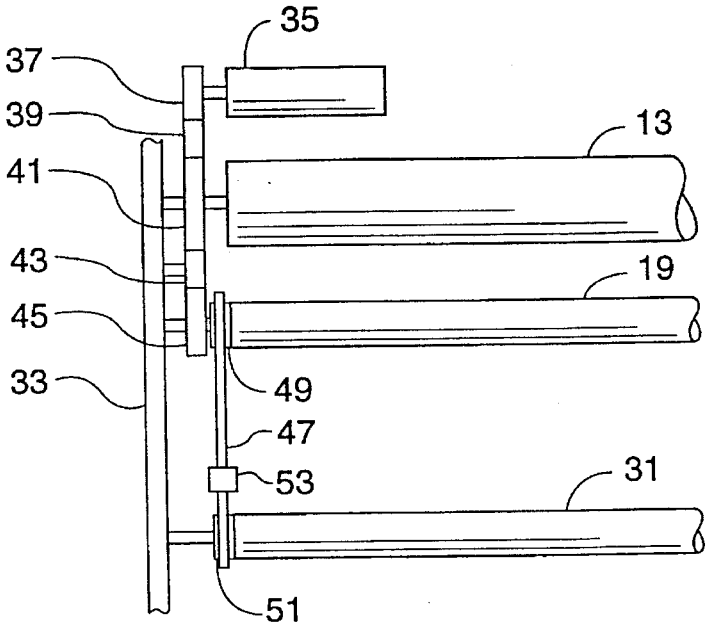
FIG. 2 is a schematic side view of the bridge roller drive arrangement of the present invention, in accordance with a preferred embodiment, showing one end of selected rollers on the press.

With the drive arrangement of FIG. 2, as the press motor 35 rotates the plate cylinder 13, the ink vibrator roller 19 is rotated by the gears 43, 45. Likewise, the ink vibrator roller 19 rotates the bridge roller 31 by way of the belt 47. The bridge roller is thus driven by the plate cylinder via the ink vibrator roller.

The bridge roller could be driven directly off of the plate cylinder by mounting a sheave on the plate cylinder. However, the drive arrangement of the present invention can be retrofitted onto existing presses. The geometry of the press components typically make it easier to retrofit the bridge roller drive arrangement using the ink vibrator roller instead of the plate cylinder. The bridge roller could be rotatably coupled to the press drive by way of gears instead of by a belt. For example, the bridge roller could be geared to the ink vibrator roller.

Figure 3:
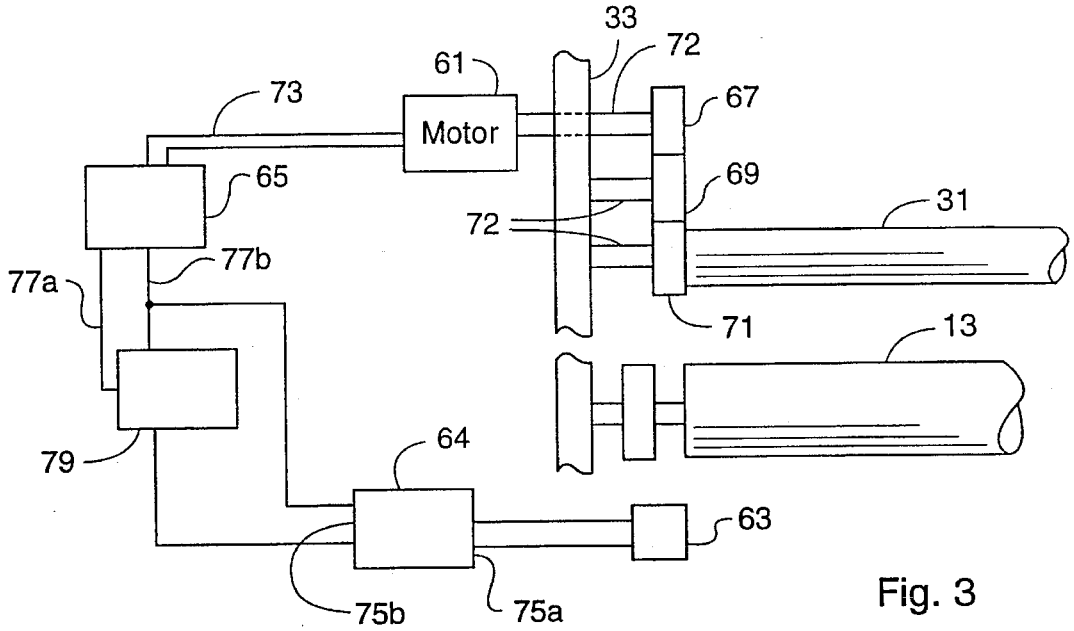
FIG. 3 is a schematic side view of another embodiment of the bridge roller drive arrangement of the present invention.

Another embodiment of the present invention is shown in FIG. 3. In this embodiment, the bridge roller drive arrangement includes a motor 61, a sensor 63 and a controller 65. This particular embodiment rotates the bridge roller independently of the other press rollers. Typically, the bridge roller will be rotated at the same surface speed as the plate cylinder. However, if printing conditions require differences between the bridge roller surface speed and the plate cylinder surface speed, then the drive roller arrangement of FIG. 3 allows these differences to be implemented.

The motor 61 is mounted to the press frame side wall 33. The electric motor 61 is rotatably coupled to one end of the bridge roller 31. This coupling could be by gears 67, 69, 71, as shown in FIG. 3. The gears are mounted to the press frame by shafts 72. One of the gears 69 is an idler gear. Alternatively, the coupling could be by a belt and sheave arrangement as shown in FIG. 2. The motor may be located outside the frame, inside the frame or wherever the geometry of the press components permit.

The sensor 63 is mounted onto the press frame so as to sense the surface speed of the plate cylinder 13. In the preferred embodiment, the sensor 63 is a dc tachometer generator. The tachometer produces a known voltage (for example 25V) per 1000 revolutions per minute, up to a maximum number of revolutions per minute. The tachometer can sense the speed of plate cylinder directly from the plate cylinder or indirectly from a component that is driven by the press, such as the press motor 35 of FIG. 2, one of the driving gears 37, 39, 41, 43, 45, or from a roller 19 driven by the press motor 35. The speed sensed by the tachometer can be related to the surface speed of the plate cylinder during calibration.

The sensor 63 is connected to a signal isolator. The signal isolator 64 produces a floating dc voltage that is proportional to the strength of the variable dc voltage signal input from the sensor 63. The sensor 63 is connected to the input 75*a* of the signal isolator 64. The output 75*b* of the signal isolator 64 is connected to a reference speed control 79. In the preferred embodiment, the reference speed control 79 is a potentiometer. A conductor 77*a* that is connected to the wiper of the potentiometer is connected to a reference speed input of the controller 65. The ends or terminals of the potentiometer are connected across the output 75*b* of the signal isolator 64. One end of the potentiometer 77*b* is connected to a ground in the controller.

The controller 65 has an output 73 that is connected to an armature of the motor 61. The controller 65 provides the current necessary to operate the motor. The controller 65 operates the motor 61 at a predetermined speed ratio to the input from the signal isolator 64. The speed ratio between the input and output is set by the reference speed control 79. The controller causes the speed of the motor (and the bridge roller) to follow the speed of the plate cylinder. In the preferred embodiment, the controller utilizes regenerative braking to control the speed of the motor.

The motor 61, the sensor 63, the isolator 64 and the controller 65 are all conventional and commercially available devices.

The drive arrangement of FIG. 3 is calibrated upon installation onto the press so that the bridge roller 31 rotates at the same surface speed as the plate cylinder 13. The signal isolator 64 has trim potentiometers that are adjusted so that the voltage on the isolator outputs will not exceed the reference voltage supplied by the potentiometer 79 to the input 77*a* of the controller 65. This trimming of the isolator output maintains the controller within its operating range. The reference speed control potentiometer 79 is adjusted so that the bridge roller rotates at the same surface speed as the plate cylinder (that is the ratio between the output of the controller and the input is one-to-one).

The operation of the drive arrangement of FIG. 3 will now be described. The sensor 63 detects the speed of the plate cylinder 13 and sends this information to the controller 65 by way of the isolator 64. The controller 65 compares the sensed plate cylinder speed with the reference speed provided by the reference speed control 79. If the plate cylinder speeds up, then the controller causes the motor 61 to follow the plate cylinder by speeding up the same amount as the plate cylinder. If the plate cylinder slows down, then the controller causes the motor 61 to follow the plate cylinder by slowing down the same amount as the plate cylinder. If there is no change in the speed of the plate cylinder, then the motor maintains its rotational speed.

It is believed that rotating the bridge roller at the same speed as the plate cylinder enhances the mixing of the ink and dampening fluid, improving print quality. The dampening form roller is typically rotated at a different speed than the plate cylinder, in order to clean hickeys off of the printing plate. Thus, with the present invention, a slip nip is formed between the bridge roller 31 and the dampening form roller 21. This slip nip produces a wiping action of one roller against the other roller to better mix the ink and dampening fluid together. To the extent that the friction driven first ink form roller 17*a* is rotating at a slower speed than the plate cylinder, another slip nip is created between the first ink form roller and the bridge roller.

The embodiment of FIG. 3 allows some flexibility in the control of the bridge roller speed. Some types of dampening systems vary the speed of the dampening form roller 21. For example, the dampening form roller may rotate at a differential speed with respect to the plate cylinder to clean hickeys off of the printing plate. This differential speed is maintained for a period of time, followed by rotating the dampening form roller at the same speed as the plate cylinder. Changing the speed of the dampening form roller between the same and differential speeds with respect to the plate cylinder is believed to reduce frictional wear on the printing plate 15 by the dampening form roller. When the dampening form roller 21 is rotating at the same surface speed as the plate cylinder 13, then the bridge roller speed can be changed to a differential surface speed with respect to the plate cylinder. This would preserve the slip nip between the dampening form roller and the bridge roller. Such a change of speed in the bridge roller is accomplished by changing the setting of the reference speed control 79.

Figure 4:
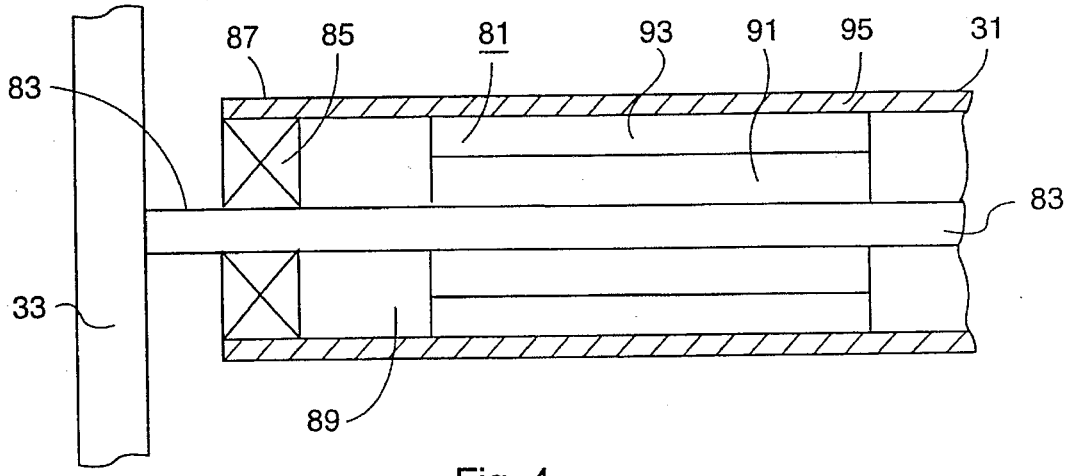
FIG. 4 is a schematic cross-sectional view of a bridge roller, in accordance with still another embodiment of the present invention.

Referring now to FIG. 4, another embodiment of the present invention will be described. This embodiment utilizes the sensor 63, isolator 64, controller 65 and reference speed control 79 of FIG. 3. The motor 81 is located inside of the bridge roller 31. This embodiment has the advantage of saving space in a press. In some press configurations, placing a motor is difficult because of a limited amount of space. The embodiment of FIG. 4 requires no external space for the motor on the press frame.

The bridge roller is mounted to the press frame by way of a dead shaft 83 which does not rotate. The bridge roller rotates about the shaft 83. Bearings 85 are provided in the ends 87 of the bridge roller. The motor 81 is located in the annular cavity 89 between the shaft 83 and the shell 95 of the bridge roller. The motor 81 can be electric, wherein a stator portion 91 of the motor is coupled to the shaft and a rotor portion 93 is coupled to the bridge roller shell 95. Wires carrying electricity to excite the stator windings are routed to the press frame through the shaft 83.

The motor 81 causes the bridge roller shell 95 to rotate about the shaft 83. The shell 95 contacts the ink roller 17*a* (see FIG. 1) and the dampening form roller 21. Electrical current is applied to the stator windings from the controller 65. The electromagnetic fields produced by the energized stator windings interact with the rotor windings and cause the rotor windings to rotate. The greater the electromagnetic fields, the stronger the interaction and the faster the rotor windings, and the shell, rotate. The rotating rotor 93 windings cause the bridge roller shell 95 to rotate about the shaft 83 and relative to the press frame 33. The controller 65 controls the amount of electrical current that is applied to the stator windings, thereby controlling the rotational speed of the bridge roller shell 95. To cause the bridge roller shell to rotate faster, more current is applied to the stator windings to increase the electromagnetic field produced by the stator windings. Conversely, to slow the bridge roller shell, less current is applied to the stator windings.

Although the present invention has discussed the motors 61, 81 as being electric, other types of motors could be used to rotate the bridge roller. For example, the bridge roller motor could be pneumatic. The press may contain other types of pneumatic drivers, wherein a compressed air supply would already be available. In fact, the bridge roller is frequently oscillated along its longitudinal axis by pneumatic means. The rollers are also activated on and off of the plate cylinder by pneumatic cylinders. The motor could also be hydraulic. If a pneumatic, hydraulic or some other type of motor is utilized to rotate the bridge roller, then the controller that is utilized is one that would be compatible with operating the specific type of motor.

Figure 5A:
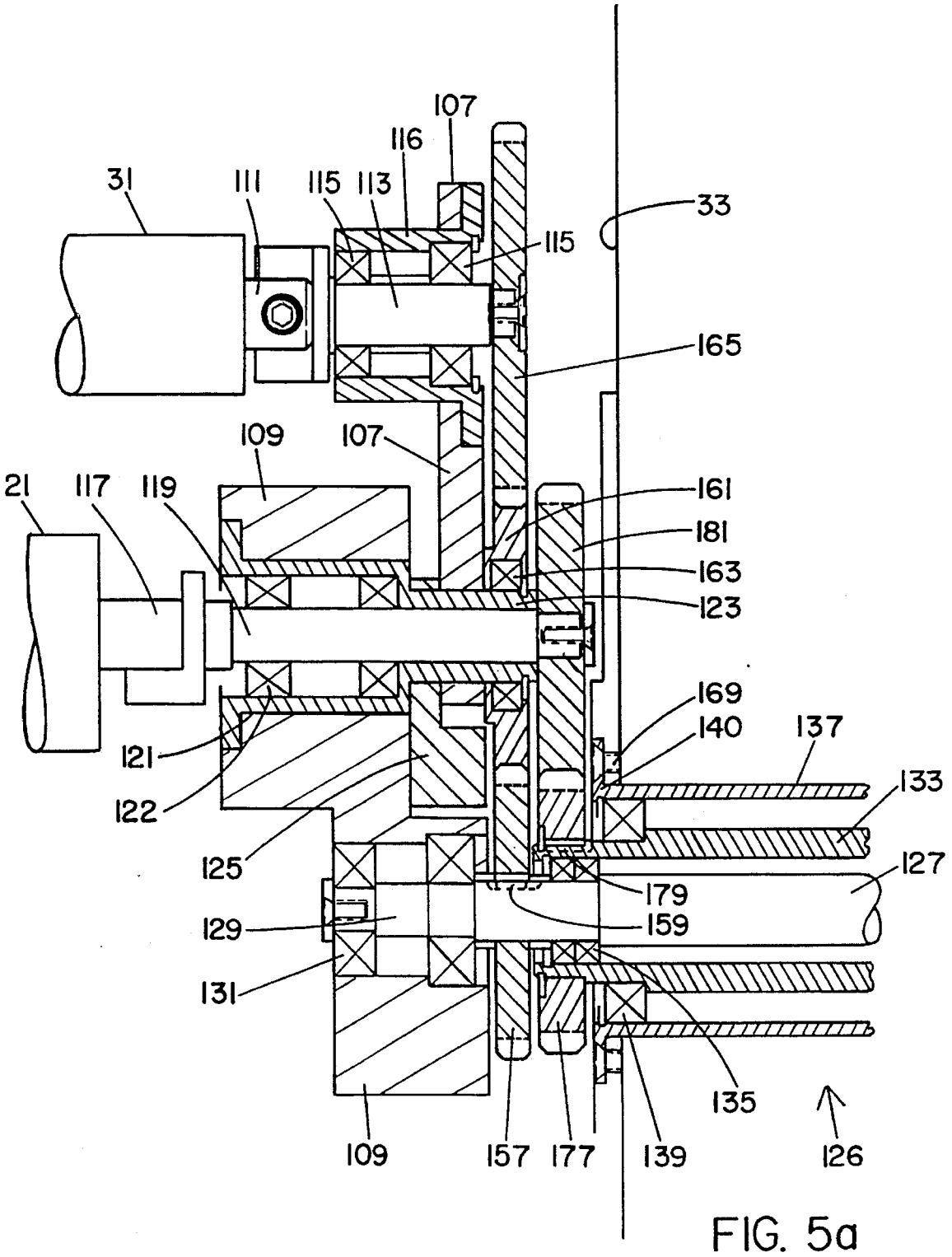
FIGS. 5*a* and 5*b* are schematic side views of another embodiment of the bridge roller drive arrangement, shown also with a drive arrangement for the dampening form roller.
Figure 5B:
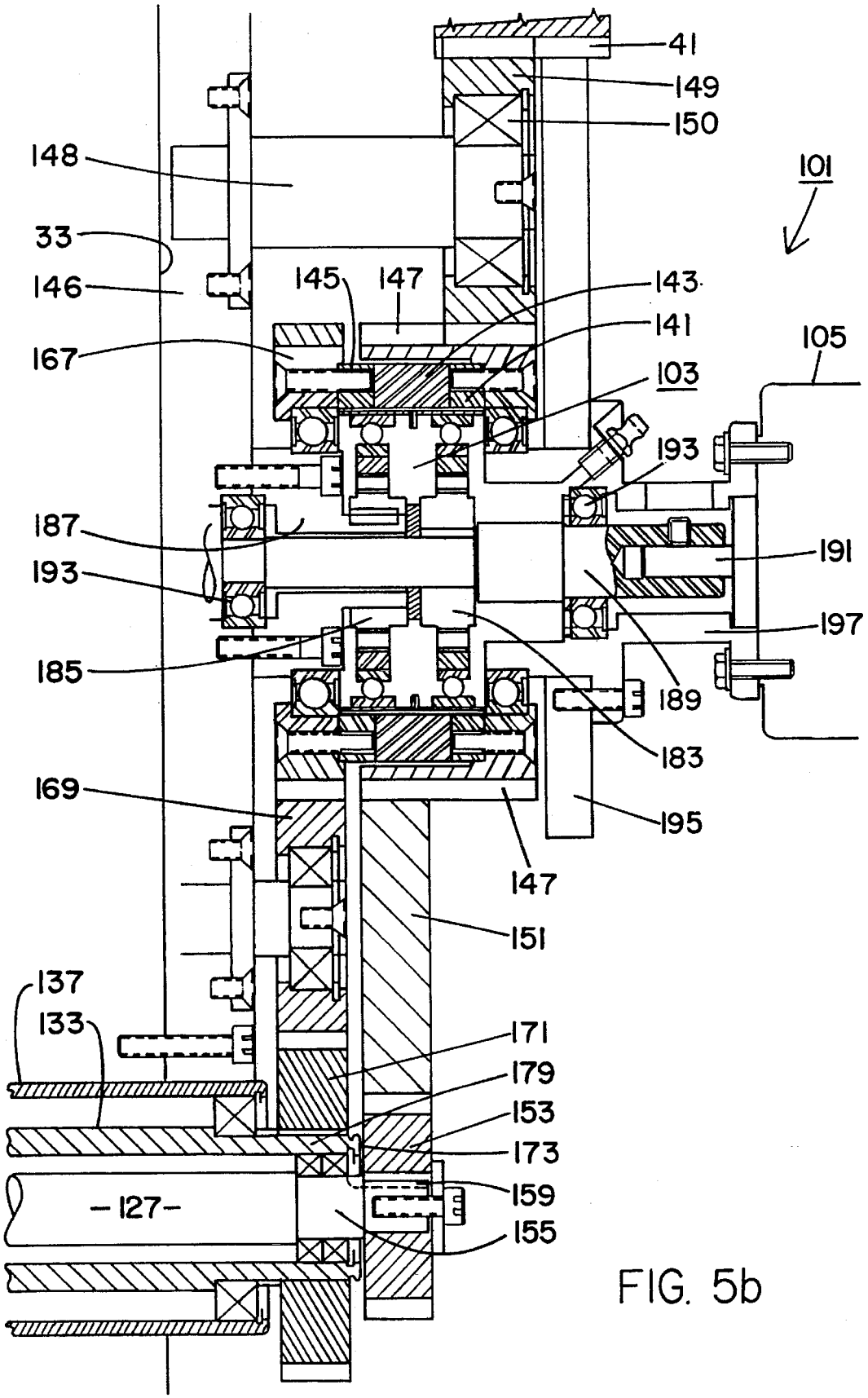

In FIGS. 5*a* and 5*b*, there is shown another embodiment of the bridge roller drive arrangement 101. (FIG. 5*a* is the left hand drawing and FIG. 5*b* is the right hand drawing. The drawings can be connected together at the inner shaft 127, the outer shaft 133 and the sleeve 137.) In general, the drive arrangement of FIGS. 5*a* and 5*b* drives the bridge roller 31 by the press drive, so that the bridge roller rotates at the same surface speed as the plate cylinder. In addition, the drive arrangement of FIGS. 5*a* and 5*b* drives the dampening form roller 21 at a variable speed. Thus, the dampening form roller 21 can be rotated at the same surface speed as the plate cylinder 13, at a slower surface speed than the plate cylinder or at a faster surface speed than the plate cylinder. The dampening form roller is driven by the press drive via a phasing differential gear set 103 (see FIG. 5*b*). A trim motor 105 is provided on the phasing differential gear set 103 so as to adjust the surface speed of the dampening form roller.

The drive arrangement of FIGS. 5*a* and 5*b* will now be described more specifically.

Referring to FIG. 5*a*, the bridge roller 31 and the dampening form roller 21 are mounted to the press frame by way of respective hangers 107, 109. The hangers 107, 109 allow the bridge roller 31 and dampening form roller 21 to pivot between an engaged position and a disengaged position with respect to the plate cylinder. In the engaged position, the dampening form roller 21 is in contact with the plate cylinder 13 and the bridge roller 31 is in contact with the dampening form roller 21 and with the upstream ink form roller 17*a* (see FIG. 1). In the disengaged position, the dampening form roller (and the ink form rollers) is out of contact with the plate cylinder, typically for washup purposes. Also, with the rollers in the disengaged position, the bridge roller is pivoted away from the plate cylinder to allow the dampening form roller to move out of contact with the plate cylinder. The bridge roller hanger 107 is mounted to the press frame by way of the dampening form roller hanger 109, which will be described hereinbelow.

The bridge roller 31 has a shaft 111 extending out of each end. Each end of the shaft 111 is coupled to an auxiliary shaft 113. Each auxiliary shaft 113 is supported by bearings 115, which in turn are supported by a sleeve 116. The sleeve 116 is coupled to the bridge roller hanger 107. The bridge roller hanger 107 is coupled to the dampening form roller hanger 109, as will be explained in more detail below. As an alternative to the auxiliary shaft 113, the end shaft 111 can be coupled directly to the hanger 107.

The dampening form roller 21 also has a shaft 117 extending out of each end. Each end of the shaft is coupled to an auxiliary shaft 119. The auxiliary shaft 119 is mounted to a sleeve 121 by way of bearings 122. The sleeve 121 is coupled to the bridge roller hanger 109. The sleeve 121 has an end portion 123 that extends from the bridge roller hanger 109 toward the press frame 33. This end portion 123, which is cylindrical, is received by a circular opening in an end of the bridge roller hanger 107. Thus, the bridge roller hanger 107 is pivotally coupled to the dampening form roller sleeve 121. A spacer 125 is located between the dampening form roller hanger 109 and the bridge roller hanger 107.

Each end of the dampening form roller 21 and the bridge roller 31 is mounted to the press frame 33 by way of hangers. However, only one end of the rollers 21, 31 is coupled to the drive arrangement shown in FIGS. 5*a* and 5*b*. Thus, one of the two dampening form roller hangers 109 is mounted to the press frame 33 by way of a concentric shaft arrangement 126. The concentric shaft arrangement 126 pivotally couples the dampening form roller 21 to the press frame 33, while allowing the dampening form roller to be rotated. Thus, the dampening form roller can be pivoted between the engaged position and the disengaged position as described above. The concentric shaft arrangement 126 also allows both the bridge roller 31 and the dampening form roller 21 to be driven by the press drive (which press drive rotates the plate cylinder 13). However, the bridge roller 31 is driven independently of the dampening form roller 21. Thus, the speed of the dampening form roller can be varied independently of the bridge roller. Likewise, the speed of the bridge roller can be varied independently of the speed of the dampening form roller.

The dampening form roller hanger 109 is coupled to an inner end 129 of an inner shaft 127 by way of bearings 131. ("Inner" and "outer" refer to the press frame 33, with "inner" being inside the press frame and "outer" being outside the press frame.) The inner shaft 127 is in turn rotatably mounted to an outer shaft 133 by way of bearings 135 (a set of bearings 135 is on each of the inner and outer ends 129, 155 of the inner shaft 127). The outer shaft 133 is in turn rotatably mounted to a sleeve 137 by way of bearings 139 (a set of bearings is on each of the inner and outer ends 175, 179 of the outer shaft 133). The sleeve 137 is in turn coupled to the press frame 33 by way of bolts 139. The bolts 139 extend through a flange 140 that is integral to the sleeve 137. The sleeve 137 extends through an opening in the press frame 33. Thus, the dampening form roller hanger 109 pivots about the inner end 129 of the inner shaft 127, which is itself rotatably coupled to the press frame. In addition, the inner shaft 127 rotates independently of the press frame 33. The outer shaft 133 also rotates independently of the press frame 33 and of the inner shaft 127.

The drive train for the bridge roller 31 will now be described. Referring to FIG. 5b, the phasing differential gear set 103 is used to rotate both the bridge roller and the dampening form roller. The phasing differential gear set 103 is coupled to an outside location of the press frame 33. The phasing differential gear set 103 has three circular splines or ring gears, namely an input spline 141, an intermediate spline 143 and an output spline 145.

An input gear 147 is bolted to the input spline 141 of the phasing differential gear set 103. The input gear 147 is wide and overlays the intermediate spline 143 so as to allow coupling or meshing with other gears. The input gear 147 rotates independently of the intermediate spline 143. The input gear 147 meshes with an idler gear 149 that is in turn meshed with the plate cylinder gear 41. The plate cylinder gear 41 is coupled to the plate cylinder 13. As shown in FIG. 2, the plate cylinder gear 41 is rotated by a motor 35 (or press drive). The idler gear 149 is rotatably coupled to a plate 146 by way of a shaft 148 and bearings 150. The plate 146 is coupled, by bolts, or some other means, to the press frame 33.

The input gear 147 is coupled to the bridge roller 31 by way of several gears and by the inner shaft 127. The input gear 147 is meshed with another idler gear 151. The idler gear 151 is coupled to the plate 146 in a manner that is similar to the coupling of the idler gear 149. (In FIGS. 5*a* and 5*b*, the axes of rotation of the gears are shown as lying in a single plane for descriptive purposes. However, press geometrics typically require the axes of rotation of the gears to be non-planar.) The idler gear 151 is in turn meshed with an outer gear 153. The outer gear 153 is coupled to the outer end 155 of the inner shaft 127. Referring to FIG. 5*a*, the inner end 129 of the inner shaft 127 is coupled to an inner gear 157. The gears 153 (FIG. 5*b*), 157 (FIG. 5*a*) are coupled to the respective ends of the inner shaft 127 by way of respective key and groove arrangements 159. The inner gear 157 is meshed with an idler gear 161. The idler gear 161 is mounted to the end 123 of the dampening form roller sleeve 121 by way of bearings 163. Thus, the idler gear 161 freely rotates about the dampening form roller sleeve 121. The idler gear 161 is meshed with a drive gear 165 that is bolted to the end of the bridge roller auxiliary shaft 113.

In the preferred embodiment, the gears are sized so that the surface speed of the bridge roller 31 is the same as the surface speed as the plate cylinder 13. Alternatively, the gears could be sized so as to drive the bridge roller at a speed that is different from (either faster or slower) the plate cylinder speed.

The operation of the drive train for the bridge roller 21 will now be described. As the plate cylinder gear 41 is rotated by the press drive 35 (see FIG. 2), the idler gear 149 (see FIG. 5*b*) is rotated by the plate cylinder gear. The idler gear 149 rotates the input gear 147 of the phasing differential gear set 103. With respect to the bridge roller, the input gear 147 acts as an idler gear, with a 1:1 speed ratio transmitted by the input gear. The input gear 147 rotates the idler gear 151, which in turn rotates the outer gear 153, which in turn rotates the inner shaft 127, which in turn (referring to FIG. 5*a*) rotates the inner gear 157, which in turn rotates the idler gear 161, which in turn rotates the drive gear 165, which in turn rotates the auxiliary shaft 113 and the bridge roller 31.

The drive train for the dampening form roller 21 will now be described. As will be explained in more detail hereinafter, the press drive 35 (by way of the idler gear 149) drives the dampening form roller 21 by way of the phasing differential gear set 103 (see FIG. 5*b*). The phasing differential gear set 103 allows the speed of the dampening form roller to be varied independently of the plate cylinder speed.

Referring to FIG. 5*b*, an output gear 167 is bolted to the output spline 145 of the phasing differential gear set 103. The output gear 167 is meshed with an idler gear 169, which is mounted on bearings and a shaft to the plate 146. The idler gear 169 is in turn meshed with an outer gear 171. The outer gear 171 is coupled to the outer end 173 of the outer shaft 133. The inner end 175 (see FIG. 5*a*) of the outer shaft 133 is coupled to an inner gear 177. The outer and inner gears 171, 177 are coupled to the respective ends of the outer shaft 133 by way of respective key and groove arrangements 179. The inner gear 177 meshes with a drive gear 181. The drive gear 181 is bolted to an end of the dampening form roller auxiliary shaft 119.

The operation of the drive train for the dampening form roller 21 will now be described. Referring to FIG. 5*b*, as the plate cylinder gear 41 is rotated by the press drive, the idler gear 149 is rotated by the plate cylinder gear 41. The idler gear 149 rotates the input gear 147 of the phasing differential gear set 103. The input gear 147 rotates the output gear 167 as will be explained herein below. As the output gear 167 of the phasing differential gear set 103 is rotated, the output gear rotates the idler gear 169, which in turn rotates the outer gear 171, which in turn rotates the outer shaft 133, which in turn rotates the inner gear 177 (see FIG. 5*a*), which in turn rotates the drive gear 181, which in turn rotates the auxiliary shaft 119, and the dampening form roller 21. The dampening form roller 21 is rotated in an opposite direction from the bridge roller 31.

The inner and outer shaft arrangement 126, along with the phasing differential gear set 103, allows the dampening form roller and the bridge roller to be driven independently of each other.

The speed of the dampening form roller relative to the speed of the plate cylinder is varied using the phasing differential gear set 103 and the trim motor 105. The phasing differential gear set 103 is a conventional and commercially available unit. One known supplier is Harmonic Drive, a division of Quincy Technologies, Inc. of Wakefield, Mass. In addition to the three circular splines 141, 143, 145, there is also provided first and second wave generators 183, 185 inside of the gear set 103. An output of the trim motor 105 is coupled to one of the wave generators. (In the preferred embodiment, the trim motor extension shaft 189 is coupled to the first wave generator 183.) The trim motor 105 is bi-directional.

To rotate the dampening form roller at the same surface speed as the plate cylinder, the trim motor 105 is off, thereby producing zero rotation of the first wave generator 183. Torque is transmitted by way of the input gear 147 to the output gear 167 through the input, intermediate and output splines 141, 143, 145. The input spline 141 drives the output spline 145 through two gear ratios. The first gear ratio is a very slight increasing ratio between the input spline 141 and the intermediate spline 143. The second gear ratio is a very slight decreasing or reduction ratio between the intermediate spline 143 and the output spline 145. The increasing and decreasing ratios offset each other (when the wave generators are stationary) and the input and output splines rotate in the same direction and at the same speed. Thus, the overall ratio between the input and the output splines is 1:1.

To vary the speed of the dampening form roller from the plate cylinder, the trim motor 105 is utilized to rotate the first wave generator 183. Rotation of the first wave generator 183 creates a high ratio speed reduction between the speed of the trim motor 105 and the speed of the input spline 141. This high ratio trim input either advances or retards (depending on the rotational direction of the trim input) the speed of the output spline 145 relative to the speed of the input spline 141. Thus, the dampening form roller can be speeded up or slowed down relative to the plate cylinder by using the trim motor.

The mounting arrangement for the phasing differential gear set 103 and the trim motor 105 will now be described. The phasing differential gear set 103 is supported on the press frame by way of a dead shaft 187 and a trim motor extension shaft 189. The dead shaft 187 is bolted to the plate 146 and extends into the phasing differential gear set. The dead shaft 187 is coupled (by way of a key and groove) to the second wave generator 185. Thus, the second wave generator is prevented from rotating. The first wave generator 183 is coupled (by way of a key and groove) to the trim motor extension shaft 189. The trim motor extension shaft has an opening for receiving the trim motor shaft 191. A set screw couples the trim motor shaft to the extension shaft. The extension shaft 189 is mounted by bearings 193 to plate 146 and to another plate 195. The two plates 146, 195, which are coupled together, form a frame for the drive arrangement to be mounted onto the press frame. The trim motor is bolted to the plate by way of a sleeve 197. The input gear 147 is coupled by bearings to the sleeve 197. The output gear 167 is coupled by bearings to the dead shaft 167.

Figure 6:
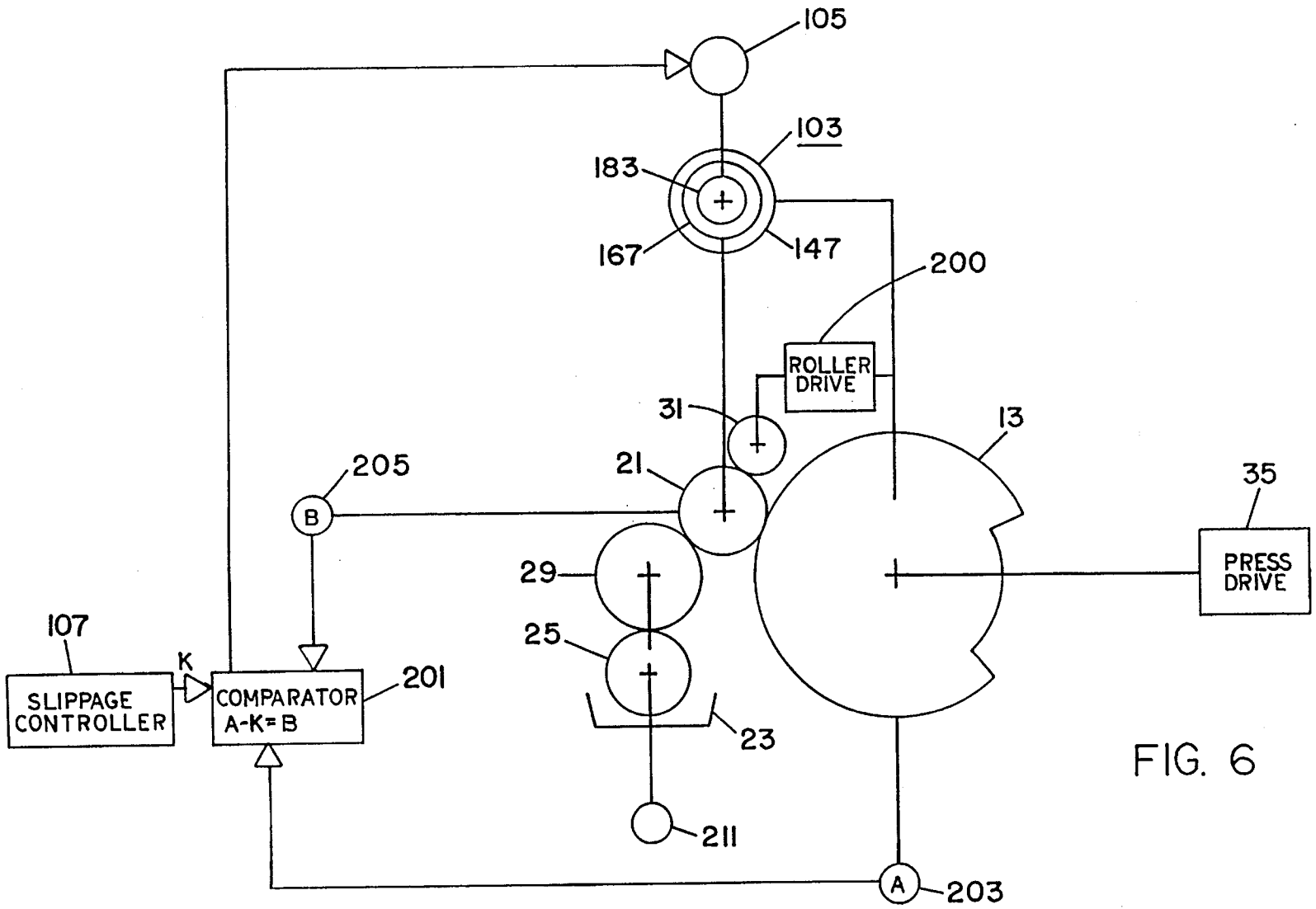
FIG. 6 is a schematic diagram showing a control circuit for use with the drive arrangement of FIGS. 5*a* and 5*b*.

Referring now to FIG. 6, the control circuit for the drive arrangement of FIGS. 5*a* and 5*b* will be described. The plate cylinder 13 is driven by a press motor 35. The plate cylinder 13 also drives the bridge roller 31 by way of a roller drive 200. The plate cylinder 13 also drives the input gear 147 of the phasing differential gear set 103. The output gear 167 of the phasing differential gear set drives the dampening form roller. The trim motor 105 rotates the first wave generator 183 inside of the phasing differential gear set 103.

The trim motor 105 is controlled by a comparator 201. The comparator 201 receives several inputs, A, B and K. One input, A, is a signal that indicates the peripheral speed of the plate cylinder 13. This input A is provided by a first speed sensor 203. Another input, B, is a signal that indicates the peripheral speed of the dampening form roller 21. This input B is provided by a second speed sensor 205. Still another input, K, is provided a slippage control 207. The slippage control 207 includes a potentiometer.

The operation of the control circuit will now be described. A press operator selects a slippage for the dampening form roller, using the slippage control 207. The comparator 201 provides an output signal to the trim motor 105. If the slippage of the dampening form roller is zero, then the output signal to the trim motor is zero, because the dampening form roller is rotated at the same surface speed as the plate cylinder. To clean hickies off of the plate cylinder, the operator provides some slippage by way of the controller 107. If the slippage of the dampening form roller is positive (wherein the dampening form roller rotates at a slower speed than the plate cylinder), then the output signal to the trim motor is of a polarity and amplitude to slow down the dampening form roller. If the dampening form roller is to rotate faster than the plate cylinder, then the output to the trim motor is of a polarity and amplitude to speed up the dampening form roller. The roller drive 200 maintains the speed of the bridge roller 31 so as to create a slip nip between the dampening form roller 21. Thus, as the dampening form roller is rotated at a differential speed with respect to the plate cylinder, there is a slip nip between the dampening form roller and the bridge roller.

The comparator 201 changes its output signal according to measured changes in the rotational speed of the dampening form roller 21. Once the slippage of the dampening form roller is set, the dampening form roller rotates at the slippage speed relative to the plate cylinder. Thus, the speed of the dampening form roller is controlled to follow the plate cylinder by the set slippage amount. As the plate cylinder speeds up, the dampening form roller will speed up by a corresponding amount. Likewise, as the plate cylinder slows down, the dampening form roller will slow a corresponding amount, to maintain the set slippage.

The comparator 201 determines the speed of the dampening form roller from the difference A–K. If the determined speed (A–K) is less than the measured speed B, then the output signal that is provided by the comparator 201 to the trim motor 105 is changed to speed up the dampening form roller. If the determined speed (A–K) is greater than the measured speed B, then the output signal that is provided to the trim motor 105 is changed to slow down the dampening form roller. If the determined speed equals or is within a predetermined range of the measured speed B, then the output signal is not changed.

Also shown in FIG. 6 is a separate motor 211 for rotating the metering roller and the transfer roller.

The bridge roller 31 can be of the oscillating type, wherein the bridge roller moves back and forth along its axis of rotation.

Although the embodiment of FIGS. 5*a* and 5*b* shows the bridge roller being driven by gears, the bridge roller can also be driven by belts off of the plate cylinder (see FIG. 2), by the motor of FIG. 3, by an internal motor (see FIG. 4), or by some other means. This is shown in FIG. 6, wherein a roller drive 200 rotates the bridge roller 31. The roller drive 200 could be the belt arrangement of FIG. 2, the motor of FIG. 3, the motor of FIG. 4, the phasing differential gear set of FIGS. 5*a* and 5*b*, or some other means. Furthermore, the bridge roller need not be driven at the same surface speed as the plate cylinder. Thus, the plate cylinder can be rotated at a first speed, while the dampening form roller is rotated at a second speed which is different than the first speed, and the bridge roller is rotated at a third speed. The third speed can be the same speed as the first (or plate cylinder) speed or it can be a different speed.

The dampening form roller need not be rotated at the second speed at all times. Typically, the dampening form roller will be rotated at a differential speed relative to the plate cylinder for a small number of revolutions of the plate cylinder. The differential speed allows the dampening form roller to clean hickies off of the plate cylinder. The dampening form roller is then returned to the same rotational surface speed as the plate cylinder, in order to minimize wear on the printing plate.

When the dampening form roller is rotated at a differential speed with respect to the plate cylinder (as with the phasing differential gear jet 103), the bridge roller 31 is rotated at a different surface speed than the dampening form roller surface speed. This creates a slip nip between the dampening form roller and the bridge roller, thereby maintaining the ink-water balance.

When the dampening form roller is rotating at the same surface speed as the plate cylinder, the bridge roller can be rotated at a differential surface speed with the plate cylinder. This differential speed creates a slip nip between the bridge roller and the dampening form roller, thereby enhancing the mixing of the ink and water.

The foregoing disclosure and the showings made in the drawings are merely illustrative of the principles of this invention and are not to be interpreted in a limiting sense.

We claim:

1. A method of operating a printing press, said press having a plate cylinder, an inking form roller, a dampening form roller, and a bridge roller, said dampening form roller and said inking form roller being in contact with a plate on said plate cylinder, said bridge roller being in contact with said dampening form roller and said inking form roller, comprising the steps of:

a) rotating said plate cylinder at a first surface speed;

b) rotating said dampening form roller at a second surface speed, said second surface speed being different from said first surface speed;

c) while rotating said dampening form roller at said second surface speed, rotating said bridge roller at a third surface speed, said third surface speed being different than said second surface speed, wherein a slip nip is created between said bridge roller and said dampening form roller, whereby a slip nip is created between the dampening form roller and the bridge roller for maintaining an ink and water balance.

2. The method of claim 1, further comprising the steps of:

a) changing the surface speed of said rotating dampening form roller from said second surface speed to said first surface speed; and b) maintaining said bridge roller rotational speed at said third surface speed.

3. The method of claim 2 wherein said third surface speed is the same speed as said first surface speed.

4. The method of claim 1 wherein said third surface speed is the same speed as said first surface speed.

5. The method of claim 1 wherein said step of rotating said dampening form roller further comprises the step of rotating said dampening form roller by a plate cylinder drive by way of a phasing differential gear set, wherein the rotational speed of said dampening form roller can be changed.

6. A printing press, comprising:

a) a plate cylinder;

b) means for rotating said plate cylinder at a first surface speed;

c) an inking form roller in contact with said plate cylinder;

d) a dampening form roller in contact with said plate cylinder;

e) a bridge roller in contact with said dampening form roller and said inking form roller;

f) means for rotating said dampening form roller at adjustable surface speeds relative to the first surface speed; and g) means for rotating said bridge roller at the first surface speed, whereby a slip nip is created between the dampening form roller and the bridge roller for maintaining an ink and water balance.

7. The printing press of claim 6, wherein said means for rotating said bridge roller at the first surface speed further comprises a gear train that is rotatably coupled to said means for rotating said plate cylinder.

8. The printing press of claim 7, wherein said means for rotating said dampening form roller at adjustable surface speeds relative to the first surface speed further comprises:

a) a phasing differential gear set having a first input and an output, said first input being coupled to said means for rotating said plate cylinder, said output being rotatably coupled to said dampening form roller, said phasing differential gear set having a second input for trimming the rotational speed of said output relative to said first input; and b) a trim motor coupled to said second input.

9. The dampening system of claim 6, wherein said means for rotating said bridge roller at the same surface speed as said plate cylinder further comprises a belt and first and second sheaves, said first sheave being coupled to a rotating member of said press that is positively rotated by said press, said second sheave-being coupled to said bridge roller, said belt being rotatably coupled to said first and second sheaves.

10. The dampening system of claim 6, wherein said means for rotating said bridge roller at the same surface speed as said plate cylinder further comprises:

a) a motor that is rotatably coupled to said bridge roller;

b) a speed sensor that is located on said press so as to determine the speed of said plate cylinder;

c) a motor speed controller having an input and an output, said controller output being connected to said motor, said controller input being connected to said sensor.

11. The dampening system of claim 10 wherein said motor is located inside of said bridge roller.

12. The dampening system of claim 6, wherein said means for rotating said dampening form roller at adjustable surface speeds relative to the first surface speed further comprises:

a) a phasing differential gear set having a first input and an output, said first input being coupled to said means for rotating said plate cylinder, said output being rotatably coupled to said dampening form roller, said phasing differential gear set having a second input for trimming the rotational speed of said output relative to said first input; and b) a trim motor coupled to said second input.

* * * * *